US009192196B2

(12) United States Patent
Sumitomo

(10) Patent No.: US 9,192,196 B2
(45) Date of Patent: Nov. 24, 2015

(54) UNDERWEAR WITH SEAMLESS NECK PORTION

(75) Inventor: Yoshiyuki Sumitomo, Osaka (JP)

(73) Assignee: PAAG CO., LTD., Osaka (JP)

( * ) Notice: Subject to any disclaimer, the term of this patent is extended or adjusted under 35 U.S.C. 154(b) by 299 days.

(21) Appl. No.: 13/813,292

(22) PCT Filed: Jan. 31, 2012

(86) PCT No.: PCT/JP2012/052116

§ 371 (c)(1),
(2), (4) Date: Jan. 30, 2013

(87) PCT Pub. No.: WO2012/111424

PCT Pub. Date: Aug. 23, 2012

(65) Prior Publication Data

US 2013/0133124 A1 May 30, 2013

(30) Foreign Application Priority Data

Feb. 17, 2011 (JP) ..... 2011-31857
Jul. 22, 2011 (JP) ..... 2011-161113

(51) Int. Cl.
*A41B 9/06* (2006.01)
*A41D 27/13* (2006.01)
*A41D 1/22* (2006.01)

(52) U.S. Cl.
CPC . *A41B 9/06* (2013.01); *A41D 27/13* (2013.01); *A41B 2300/35* (2013.01); *A41B 2400/38* (2013.01); *A41B 2500/10* (2013.01); *A41D 1/22* (2013.01)

(58) Field of Classification Search
CPC ..... A41B 9/06; A41B 1/22
USPC ..... 2/69, 73, 103, 106, 107, 109, 110, 113, 2/468; 450/3, 11, 30
See application file for complete search history.

(56) References Cited

U.S. PATENT DOCUMENTS 2,554,380 A * 5/1951 Olrich et al. ..... 2/90
3,474,465 A * 10/1969 Artzt ..... 2/113
3,488,776 A * 1/1970 Luhr ..... 2/109
4,601,066 A * 7/1986 Campbell ..... 2/70
4,821,343 A * 4/1989 Quealy ..... 2/102
5,109,546 A * 5/1992 Dicker ..... 2/70

(Continued)

FOREIGN PATENT DOCUMENTS

JP 8-60405 3/1996
JP 3061254 9/1999

(Continued)

*Primary Examiner* — Danny Worrell
*Assistant Examiner* — Khaled Annis
(74) *Attorney, Agent, or Firm* — Wenderoth, Lind & Ponack, L.L.P.

(57) ABSTRACT

An underwear includes: a front body formed by a stretchable material and having a cylindrical high neck portion covering a neck at a top portion thereof; and a back body formed by a stretchable material, having both bottom side edges stitched to both bottom side edges of the front body, a top edge stitched to a region from a bottom end of the neck portion to a shoulder, and both top side edges forming armholes. The front body is made of a cylindrical material and is formed by cutting the cylindrical material in an axial direction from a bottom opening portion thereof to the high neck portion. The back body is made of a cylindrical material and is formed by cutting the cylindrical material in an axial direction from one end opening portion thereof to the other end opening portion.

9 Claims, 8 Drawing Sheets

(56) References Cited

U.S. PATENT DOCUMENTS

| | | | | |
|---|---|---|---|---|
| 5,206,957 | A * | 5/1993 | Gulick | 2/84 |
| 5,388,271 | A * | 2/1995 | Sessoms | 2/115 |
| 5,469,581 | A * | 11/1995 | Uthoff | 2/69 |
| 5,526,532 | A * | 6/1996 | Willard | 2/69 |
| 5,659,895 | A * | 8/1997 | Ford, Jr. | 2/2.11 |
| 5,768,703 | A * | 6/1998 | Machado et al. | 2/2.15 |
| 6,231,488 | B1 * | 5/2001 | Dicker et al. | 482/124 |
| 6,292,947 | B1 * | 9/2001 | Bechis | 2/67 |
| 6,347,407 | B1 * | 2/2002 | Dowell | 2/113 |
| 6,688,942 | B2 * | 2/2004 | Holliday | 450/39 |
| 8,418,262 | B2 * | 4/2013 | Angus | 2/2.5 |
| 8,533,864 | B1 * | 9/2013 | Kostrzewski | 2/69 |
| 2004/0137821 | A1 * | 7/2004 | Sandroussi et al. | 450/34 |
| 2005/0028240 | A1 * | 2/2005 | Brennan | 2/69 |
| 2005/0278820 | A1 * | 12/2005 | Newman | 2/69 |
| 2006/0105672 | A1 * | 5/2006 | Donnelly | 450/3 |
| 2009/0031486 | A1 * | 2/2009 | Sokolowski et al. | 2/458 |
| 2009/0307823 | A1 * | 12/2009 | Matsushita et al. | 2/116 |
| 2010/0010568 | A1 * | 1/2010 | Brown | 607/48 |
| 2010/0099332 | A1 * | 4/2010 | Noel | 450/27 |
| 2013/0133124 | A1 * | 5/2013 | Sumitomo | 2/113 |

FOREIGN PATENT DOCUMENTS

| | | |
|---|---|---|
| JP | 11-269702 | 10/1999 |
| JP | 3094056 | 5/2003 |
| JP | 2005-113338 | 4/2005 |
| JP | 2005-290584 | 10/2005 |
| JP | 2006-104642 | 4/2006 |
| JP | 2010-189784 | 9/2010 |

* cited by examiner

UNDERWEAR WITH SEAMLESS NECK PORTION

BACKGROUND OF THE INVENTION

1. Field of the Invention

The present invention relates to underwear worn mainly by women.

2. Description of Related Art

Humans cannot avoid having noticeable wrinkles, sags, or spots as they grow older. In particular, the wrinkles or the like bother women. Therefore, women who have noticeable wrinkles or the like hesitate to wear clothes with a wide-open breast portion. Also, regardless of age, due to cold, humans hesitate to wear clothes with a wide-open breast portion in the winter season or in well-cooled places.

Japanese Patent Application Laid-Open No. 2005-113338 describes underwear that is sewed using skin color stockings that are excellent in stretching property. The underwear is configured to cover from the neck to the bottom of the bust. Therefore, the underwear can secure warmth while hiding the wrinkles or the like of a wearer.

Among the underwear described in Japanese Patent Application Laid-Open No. 2005-113338, in the case of seamless underwear, the production cost increases because it is necessary to manufacture a dedicated production machine. Also, Japanese Patent Application Laid-Open No. 2005-113338 describes a method for producing underwear by using conventional panty hose. However, the production method thereof is complex, and thus the productivity thereof is poor. Accordingly, the underwear described in Japanese Patent Application Laid-Open No. 2005-113338 is expensive.

In addition, in the underwear described in Japanese Patent Application Laid-Open No. 2005-113338, when the wearer moves the neck, shoulder, arm, and the like, a sagging occurs particularly at the cloth ranging from the shoulder to the neck, and the sagging causes a wrinkle. Therefore, although an object of the underwear described in Japanese Patent Application Laid-Open No. 2005-113338 is to hide wrinkles or the like, a noticeable wrinkle is generated by the cloth in a region where a wrinkle hardly occurs in usual cases.

SUMMARY OF THE INVENTION

A first object of the present invention is to produce, at low cost, an underwear that can cover wrinkles or the like of a wearer. Also, a second object of the present invention is to provide an underwear that can prevent the generation of a wrinkle at a cloth in the state of being worn.

In order to solve the above problems, an underwear of the present invention includes a front body formed by a stretchable material and having a cylindrical neck portion covering a neck at a top portion thereof; and a back body formed by a stretchable material, having both bottom side edges stitched to both bottom side edges of the front body, a top edge stitched to a region from a bottom end of the neck portion to a shoulder, and both top side edges forming armholes. The front body is made of a cylindrical material and is formed by cutting the cylindrical material in an axial direction from a bottom opening portion thereof to the neck portion. The back body is made of a cylindrical material and is formed by cutting the cylindrical material in an axial direction from one end opening portion thereof to the other end opening portion.

Since the underwear of the present invention is sewed by the stretchable material, a wrinkle of the skin can be covered by the wearing of the underwear. In addition, warmth can be secured in the winter season or in the well-cooled places, and ultraviolet rays can be blocked in the spring, summer and fall seasons. Also, since the cylindrical neck portion is integrated with the front body, and since the back body is stitched to both bottom side edges of the front body and to a region from the bottom end of the neck portion to the shoulder, there is no seam on the front side of the wearer. Also, since the front body and the back body are formed by cutting a cylindrical material in the axial direction from a bottom opening portion thereof to the neck portion, the material can be produced by a general-purpose machine for manufacturing stockings. Accordingly, the production cost can be reduced, and thus the underwear can be provided to a user at a low price.

In the underwear, it may be preferable that a cylindrical sleeve formed by a stretchable material and preventing both top portions of the front body from moving toward the neck portion is stitched to the armhole. In this way, a cloth sagging on the shoulder can be prevented more securely.

Also, it may be preferable to further include a sagging preventing portion preventing both top portions of the front body from moving toward the neck portion such that at least a portion thereof is located around the armhole. In this way, even when the wearer moves the neck, the shoulders, the arms, or the like, sagging at the cloth ranging from the shoulder to the neck can be prevented securely. As a result, the generation of a wrinkle at the front body can be prevented. Accordingly, by using a skin color material, the underwear can appear as if the skin is exposed.

In addition, it may be preferable that the sagging preventing portion is provided along the bottom side of the armhole from the front body to the back body.

Alternatively, it may be preferable that the sagging preventing portions are provided in a pair at the back body to be extended from the armhole of the one side toward the hem of the other side.

Alternatively, it may be preferable that the sagging preventing portion is provided around the entire periphery along the armhole.

In this way, the generation of a wrinkle at the region ranging from the shoulder to the neck can be prevented securely.

In addition, it may be preferable that the sagging preventing portion is provided by stitching a strip-shaped stretchable member.

Alternatively, it may be preferable that the sagging preventing portion is provided by coating silicone.

In this way, the stretching force of the front body and the back body can be simply and securely made different from the stretching force of the sagging preventing portion. Therefore, the movement of the armhole portion of the front body toward the high neck portion can be prevented securely.

Alternatively, it may be preferable to provide a sagging preventing portion that is formed by a strip-shaped stretchable member stitched such that at least a portion thereof is located around the armhole, and prevents both top portions of the front body from moving toward the neck portion, wherein an armpit pad is stitched to the sagging preventing portion. In this way, since the sweat of the wearer can be prevented from seeping, it does not make an ill appearance. Also, since the edge of the stretchable member can be prevented from contacting the armpit of the wearer, wearability can be improved.

The underwear of the present invention can cover a wrinkle of a skin, secure warmth and block ultraviolet rays when worn. Also, since the front body and the back body are formed by cutting a cylindrical material in the axial direction, the material can be produced by a general-purpose machine for manufacturing stockings. Accordingly, the production cost can be reduced, and thus the underwear can be provided to a user at a low price. In addition, the underwear has no seam in the front side of a wearer, and prevents the generation of a wrinkle at the front body by the sleeve or the sagging preventing portion. Therefore, by using a skin color material, the underwear can appear as if the skin is exposed. Accordingly, even a woman bothered with skin wrinkles will not hesitate to wear clothes with a wide-open breast portion.

DETAILED DESCRIPTION OF THE PREFERRED EMBODIMENT

Hereinafter, embodiments of the present invention will be described with reference to the drawings.

Figure 1:
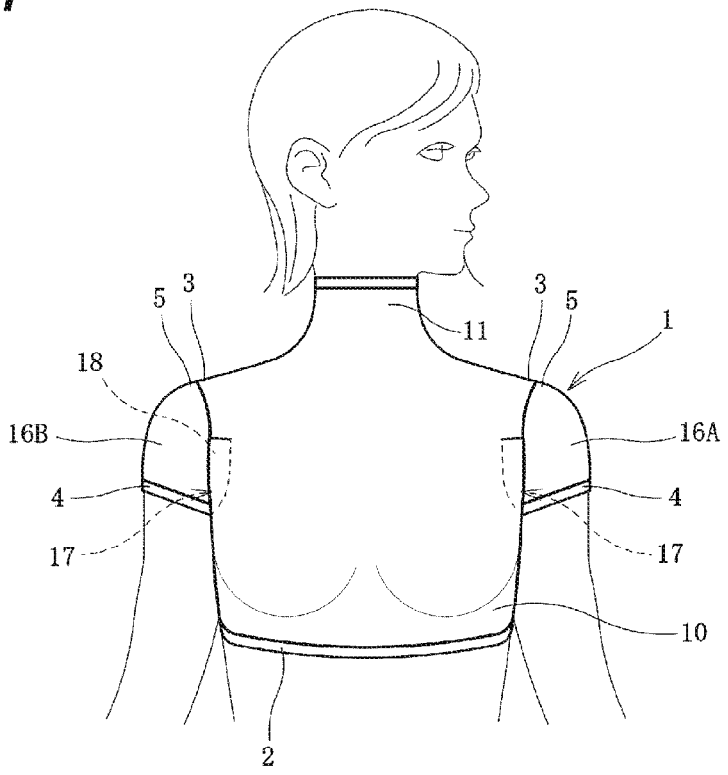
FIG. 1 is a front view illustrating underwear according to a first embodiment of the present invention in the state of being worn.
Figure 2:
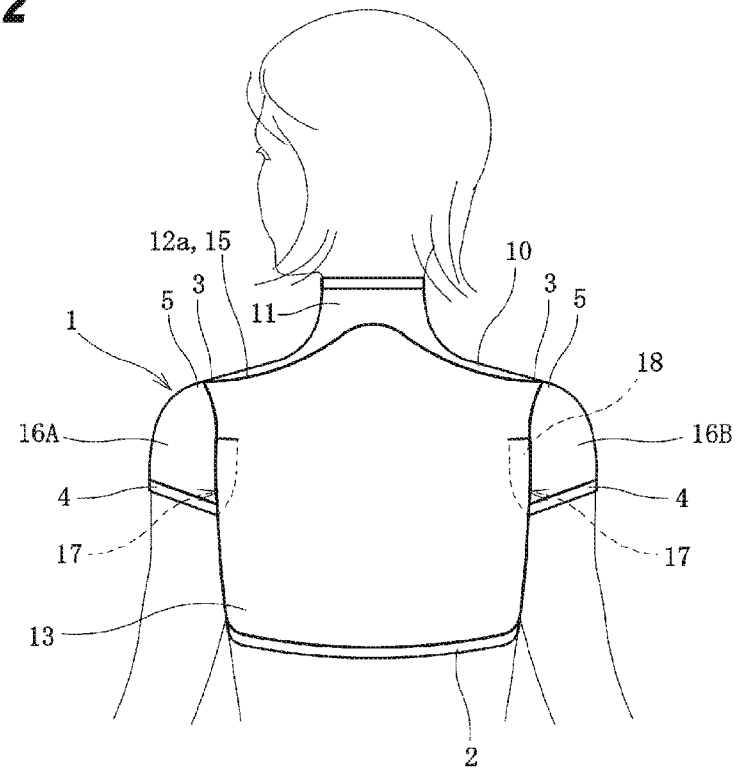
FIG. 2 is a rear view illustrating the underwear of FIG. 1 in the state of being worn.
Figure 3:
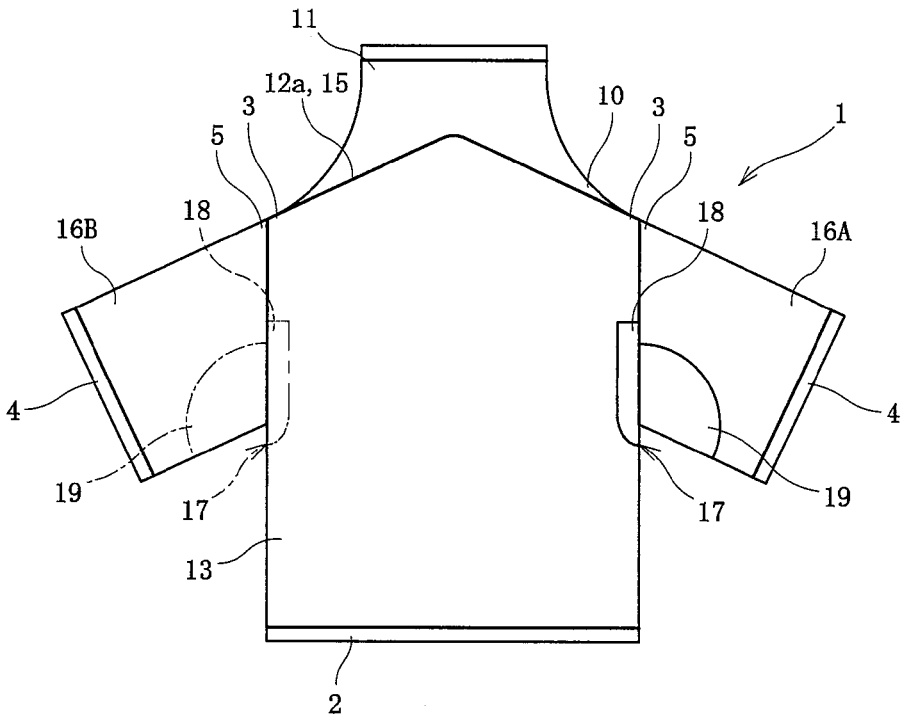
FIG. 3 is a rear view illustrating the underwear of FIG. 1 in the state of being turned inside out and flattened.
Figure 4:
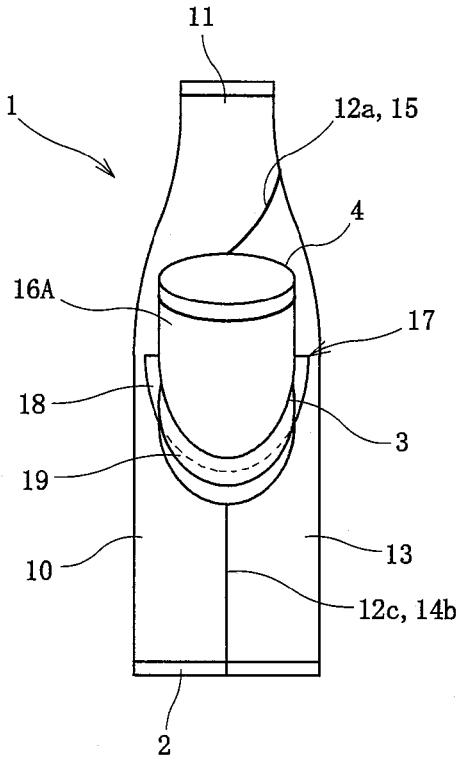
FIG. 4 is a side view illustrating the underwear of FIG. 1 in the state of being turned inside out.

FIGS. 1 to 3 illustrate underwear 1 according to a first embodiment of the present invention. The underwear 1 is sewed by stitching a front body 10, a back body 13, and a pair of sleeves 16A and 16B. The front body 10, the back body 13, and the pair of sleeves 16A and 16B are formed by a skin color stretchable material that is excellent in stretching property, breathability, and sweat drying property and is also used in stockings. The underwear 1 of the present invention improves productivity and can be provided at a low price. Also, the underwear 1 has no seam in the front side of a wearer. Also, the underwear 1 is provided with a sagging preventing portion 17 to suppress the generation of a wrinkle at the front body 10.

Figure 5A:
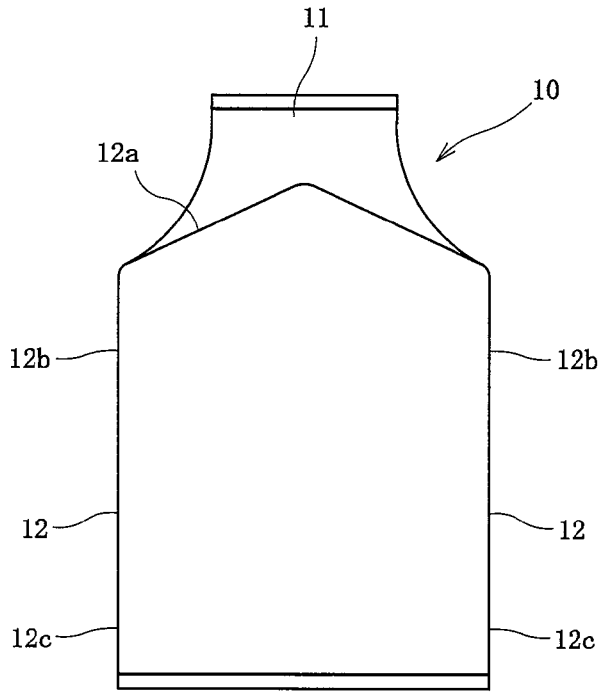
FIG. 5A is a rear view illustrating a front body in the state of being flattened.
Figure 5B:
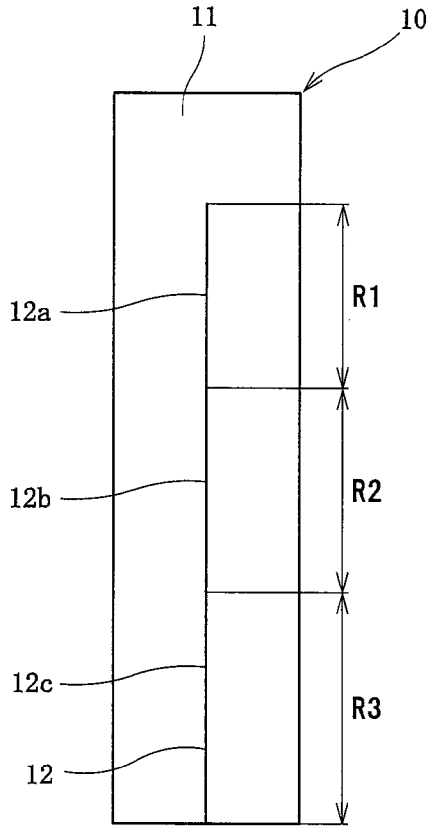
FIG. 5B is a rear view illustrating a cylindrical material from which the front body is made.

The front body 10 is a length that covers an upper side from a bottom portion of a bust of the wearer (under bust). As illustrated in FIG. 5A, a cylindrical high neck portion 11 covering the neck is integrated with a top portion of the front body 10. Therefore, the front body 10 has no seam to be the boundary with respect to the high neck portion 11. As illustrated in FIG. 5B, the front body 10 uses a cylindrical material that can be stretched by about 2-3 times from the contracted state. The cylindrical material can be produced by a general-purpose machine for manufacturing stockings. The front body 10 is formed by cutting the cylindrical material in the axial direction from the bottom opening portion to the high neck portion 11. After the cutting, cutting edges 12 are unfolded, and the bottom end being a hem line 2 and the top end of the high neck portion 11 being a neck line are folded inward and subjected to a fray-prevention process. Also, among the cutting edge 12, a region R1 ranging from a cutting end being the bottom end of the high neck portion 11 to a dimension half of the width of the back body 13 becomes a shoulder line 12*a* stitched to the back body 13. Also, a region R2 on both edges stitching the sleeves 16A and 16B under the shoulder line 12*a* becomes an armhole portion 12*b* that constitutes an armhole 3. In addition, a region R3 under both edges located under the armhole portion 12*b* becomes a side line 12*c*.

Figure 6A:
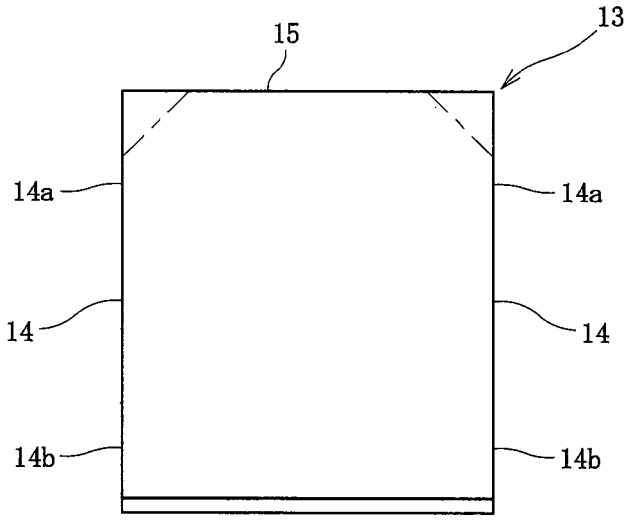
FIG. 6A is a rear view illustrating a back body in the state of being flattened.
Figure 6B:
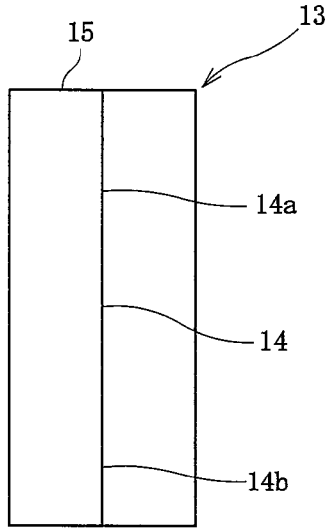
FIG. 6B is a rear view illustrating a cylindrical material from which the back body is made.

As illustrated in FIG. 6A, the back body 13 has a rectangular shape with a total height corresponding to the sum of the armhole portion 12*b* and the side line 12*c* of the front body 10. As illustrated in FIG. 6B, the back body 13 is formed by cutting a cylindrical material, which has the same diameter as the front body 10, in the axial direction from the bottom opening portion to the top opening portion. After the cutting, cutting edges 14 are unfolded, and the bottom end being the hem line 2 is folded inward and subjected to a fray-prevention process. Also, a top portion of the cutting edge 14 becomes an armhole portion 14*a*, and a bottom portion of the cutting edge 14 becomes a side line 14*b* stitched to the side line 12*c* of the front body 10. Also, a top edge of the back body 13 becomes a shoulder line 15 stitched to the shoulder line 12*a* of the front body 10.

Figure 7A:
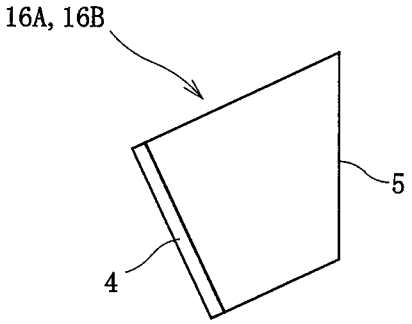
FIG. 7A is a front view illustrating a sleeve portion in the state of being flattened.
Figure 7B:
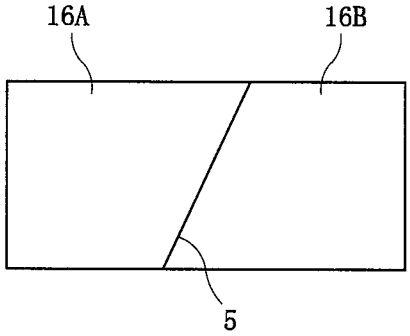
FIG. 7B is a front view illustrating a cylindrical material from which the sleeve portions are made.

As illustrated in FIG. 7A, the sleeves 16A and 16B are formed by cutting a cylindrical material that has the same diameter as the front body 10 and the back body 13. A sleeve hem 4 located at the left side of the drawing is folded inward and subjected to a fray-prevention process. Also, a sleeve cap 5 located at the right side of the drawing is cut to be inclined at a predetermined angle. In the present embodiment, as illustrated in FIG. 7B, the pair of sleeves 16A and 16B are formed by cutting a cylindrical material at the inclination angle of the sleeve cap 5, and then processing the sleeve hem 4.

Figure 8A:
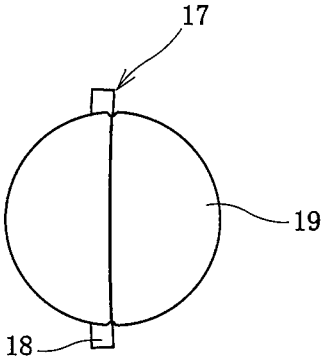
FIGS. 8A and 8B are front and side views illustrating a stretchable member and an armpit pad that constitute a sagging preventing portion.
Figure 8B:
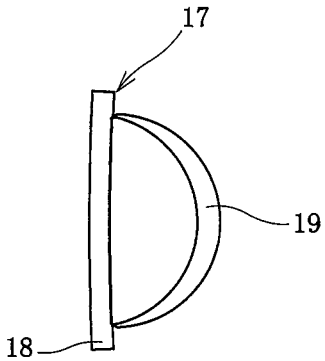

As illustrated in FIGS. 1 to 3, the sagging preventing portions 17 are provided to be located around the armholes 3 that are formed by stitching the front body 10 and the back body 13. As illustrated in FIGS. 5, 8A, and 8B, the sagging preventing portion 17 of the present embodiment is formed by stitching a strip-shaped stretchable member 18 that is formed by a stretchable material that has a stronger stretching force than the stretchable material that constitutes the front body 10, the back body 13, and the sleeves 16A and 16B. The stretchable member 18 is disposed along the lower side of the armhole 3, and end portions thereof are stitched to the front body 10 and the back body 13. Also, an armpit pad 19 formed by a substantially circular sheet (in the illustration, folded in half) is stitched to the stretchable member 18. As for the armpit pad 19, a commercially-available underarm sweat pad having good absorbing property and drying property may be attached, and a pad material having good absorbing property and drying property may be sewed therein.

In order to sew the underwear 1 formed by these members, for example, first, the center of the shoulder line 15 of the back body 13 is positioned at the end portion of the cutting edge 12 of the front body 10, and the shoulder line 12*a* of the front body 10 and the shoulder line 15 of the back body 13 are stitched together. Subsequently, the side line 12*c* of the front body 10 and the side line 14*b* of the back body 13 are positioned and are stitched together. Thereafter, the sleeves 16A and 16B are positioned at and stitched to the armhole 3 that are formed by the non-stitching portions of the front body 10 and the back body 13. Lastly, the stretchable member 18 is disposed along the armhole 3, and the end portions thereof are stitched to the front body 10 and the back body 13.

In the underwear 1 sewed as above, the shoulder lines 12*a* and 15 being the seams of the front body 10 and the back body 13 are located on the back side as illustrated in FIGS. 2 and 3. This is because the front body 10 is formed by cutting the cylindrical material from the hem line 2 to the high neck portion 11. Herein, on the back side, the shoulder lines 12*a* and 15 appear at the bottom end of the high neck portion 11. However, since the shoulder lines 12*a* and 15 are covered with the hair of the wearer, the appearance is not impaired.

When the underwear 1 is worn, the front body 10, the back body 13, and the sleeves 16A and 16B are stretched, and the stretchable member 18 is also stretched. The high neck portion 11 is in close contact with the wearer's neck, the sleeves 16A and 16B are in close contact with the arms, and the hem line 2 is in close contact with the under bust. Also, since the breast of the woman wearer is swollen, the front body 10 and the back body 13 are fully extended such that the front body 10 and the back body 13 are in close contact with the skin. Herein, since the front body 10 and the back body 13 cannot be in close contact with small prominences on the surface of the skin, the prominences by wrinkles do not appear on the surface.

Also, around the armhole 3, the underwear 1 is provided with the sagging preventing portion 17 formed by the stretchable member 18 having a strong stretching force. The sagging preventing portion 17 is in surface contact with the armpit of the wearer. Therefore, the armhole portion 12*b* of the armhole 3 of the front body 10 is stretched toward the outside of the width direction and the side of the back body 13, and the armhole portion 14*a* of the armhole 3 of the back body 13 is likewise stretched toward the outside of the width direction and the side of the front body 10. As a result, a tensile force is applied to a region of the underwear 1 ranging from the shoulder to the neck such that the front body 10 and the back body 13 are in closer contact with the skin. In addition, since the sleeves 16A and 16B are stitched to the armhole 3, the underwear 1 of the present embodiment can obtain the frictional resistance between the sleeves 16A and 16B and the arms of the wearer. Accordingly, even when the wearer moves the neck, the shoulders, the arms, or the like, a sagging is not generated between the skin and the cloth of the underwear 1.

In this manner, since the underwear 1 of the present embodiment is sewed by the stretchable material, a wrinkle of the skin can be covered by the wearing of the underwear 1. In addition, warmth can be secured in the winter season or in the well-cooled places, and ultraviolet rays can be blocked in the spring, summer and fall seasons.

Also, since the high neck portion 11 is integrated with the front body 10, and since the side line 12*c* of the front body 10 and the shoulder line 12*a* ranging from the bottom end of the high neck portion 11 to the shoulder are stitched to the side line 14*b* and the shoulder line 15 of the back body 13, there is no seam in the front side body portion of the wearer except stitching between sleeves 16A, 16B, and armholes 3. In addition, the sagging preventing portion 17 is provided around the armhole 3. Therefore, even when the wearer moves the neck, the shoulders, the arms, or the like, a cloth sagging can be prevented from being generated at the region ranging from the armhole 3 (shoulder) to the high neck portion 11 (neck). As a result, since the front body 10 has no seam and wrinkle, the underwear can appear as if the wearer's skin is exposed. Accordingly, by wearing the underwear 1, even a woman bothered with skin wrinkles cannot hesitate to wear clothes with a wide-open breast portion.

In addition, since the sleeves 16A and 16B are stitched to the armhole 3 of the underwear 1, the position of the cloth of the portion of the armhole 3 can be more securely prevented from being misaligned toward the high neck portion 11, by the friction with the arm having passed through the sleeves 16A and 16B. Also, since the armpit pad 19 is stitched to the stretchable member 18, the sweat of the wearer can be prevented from seeping. Accordingly, even when the wearer sweats, it does not make an ill appearance. In addition, since the edge of the sagging preventing portion 17 can be prevented from contacting the armpit of the wearer, wearability can be improved.

In addition, in the present embodiment, since the front body 10, the back body 13 and the sleeves 16A and 16B are formed by cutting the cylindrical material, the material can be produced by a general-purpose machine for manufacturing stockings. In addition, by cutting and stitching the cylindrical material in the axial direction, the underwear 1 can be sewed simply and securely. Accordingly, the production cost can be reduced, and thus the underwear can be provided to a user at a low price. Furthermore, because the high neck portion 11 is cylindrical, there are no vertical seams in the high neck portion 11 (i.e., the neck portion 11 is seamless). In addition, because the high neck portion 11 is integrated with the front body 10, there is no seam along the boundary between the front body 10 and the high neck portion 11 (i.e., the neck portion 11 is an integral portion of the front body 10).

Figure 9:
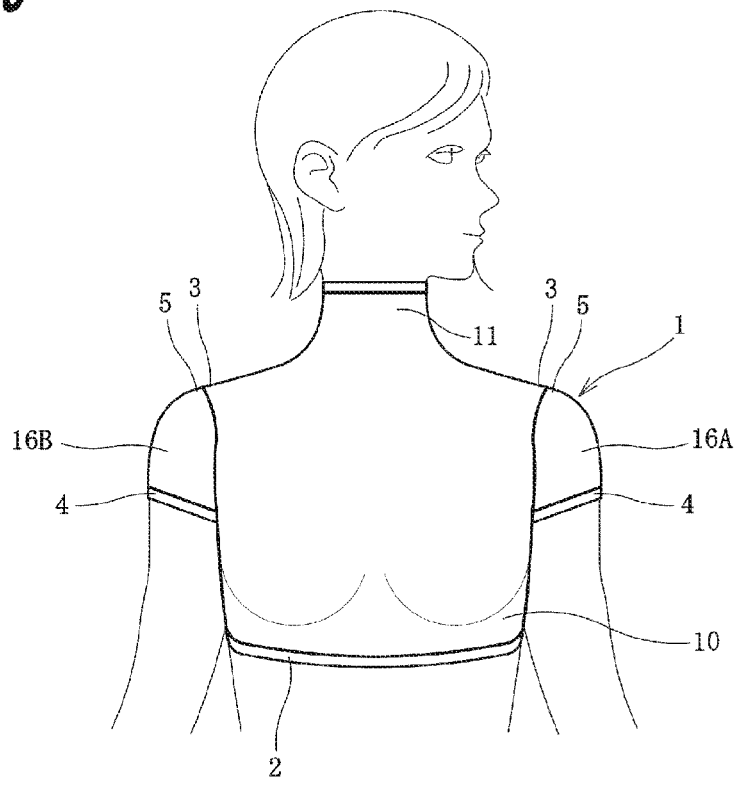
FIG. 9 is a front view illustrating underwear according to a second embodiment in the state of being worn.
Figure 10:
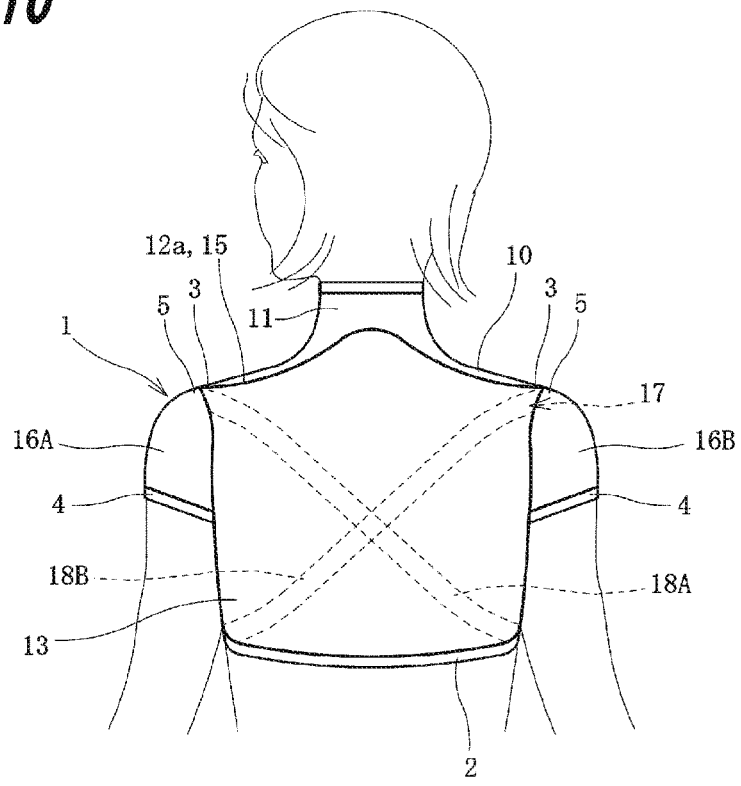
FIG. 10 is a rear view illustrating the underwear of FIG. 9 in the state of being worn.
Figure 11:
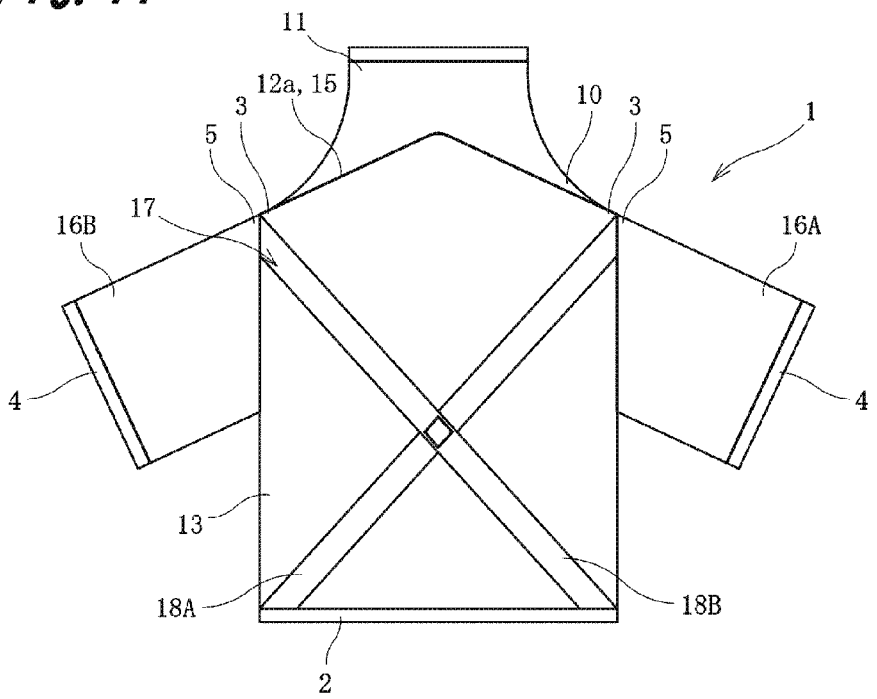
FIG. 11 is a rear view illustrating the underwear of FIG. 9 in the state of being turned inside out and flattened.

FIGS. 9 to 11 illustrate underwear 1 according to a second embodiment. The second embodiment is different from the first embodiment only in the configuration of the sagging preventing portion 17. The sagging preventing portion 17 of the second embodiment uses a pair of stretchable members 18A and 18B like that of the first embodiment. The stretchable members 18A and 18B have one end stitched to an armhole 3 of one side of a back body 13, and the other end stitched to a hem line 2 of the other side of the back body 13. That is, the first stretchable member 18A has one end stitched to a top portion of the left armhole 3, and the other end stitched to a right side of the hem line 2. Also, the second stretchable member 18B has one end stitched to a top portion of the right armhole 3, and the other end stitched to a left side of the hem line 2. The stretchable members 18A and 18B are integrated with their intersecting portions stitched together.

When the underwear 1 of the second embodiment is worn, the sagging preventing portion 17 formed by the stretchable members 18A and 18B operate to stretch the front body 10 toward the back body 13. As a result, as in the first embodiment, a tensile force is applied to a region of the underwear 1 ranging from the shoulder to the neck such that the region is in close contact with the skin. Accordingly, even when the wearer moves the neck, the shoulders, the arms, or the like, a sagging is not generated between the skin and the cloth of the underwear 1. Therefore, the generation of a wrinkle at the front body 10 can be prevented securely.

Figure 12:
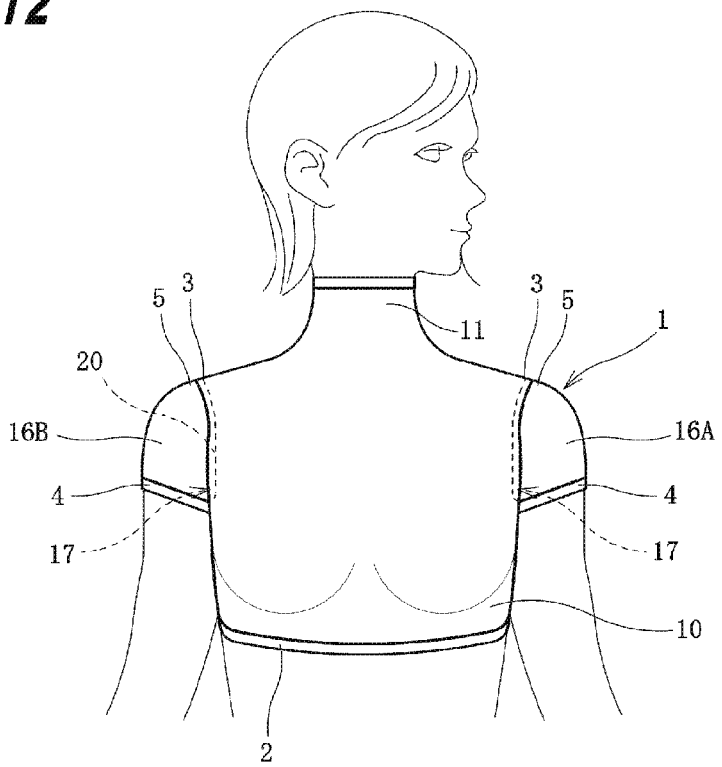
FIG. 12 is a front view illustrating underwear according to a third embodiment in the state of being worn.
Figure 13:
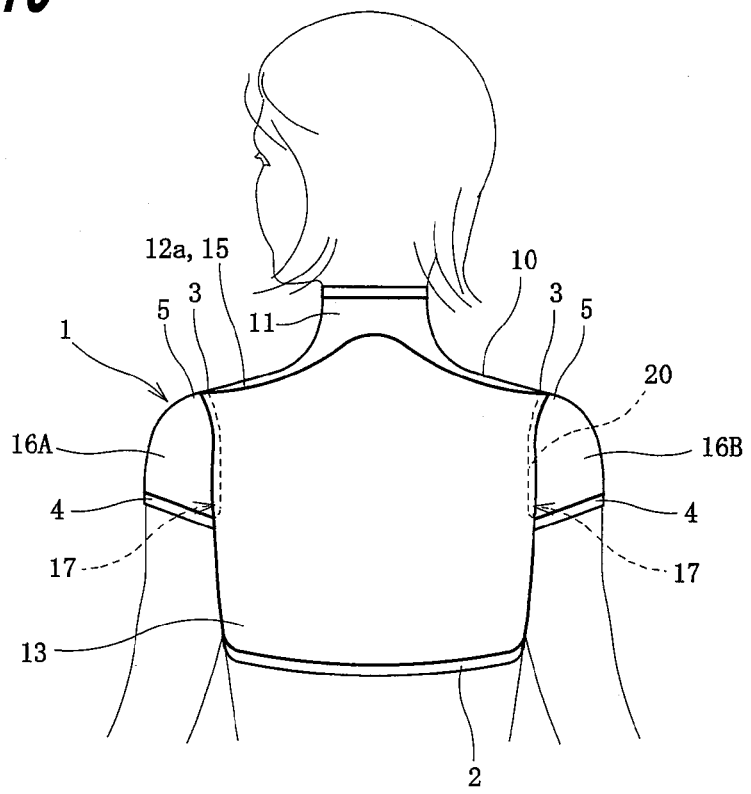
FIG. 13 is a rear view illustrating the underwear of FIG. 12 in the state of being worn.
Figure 14:
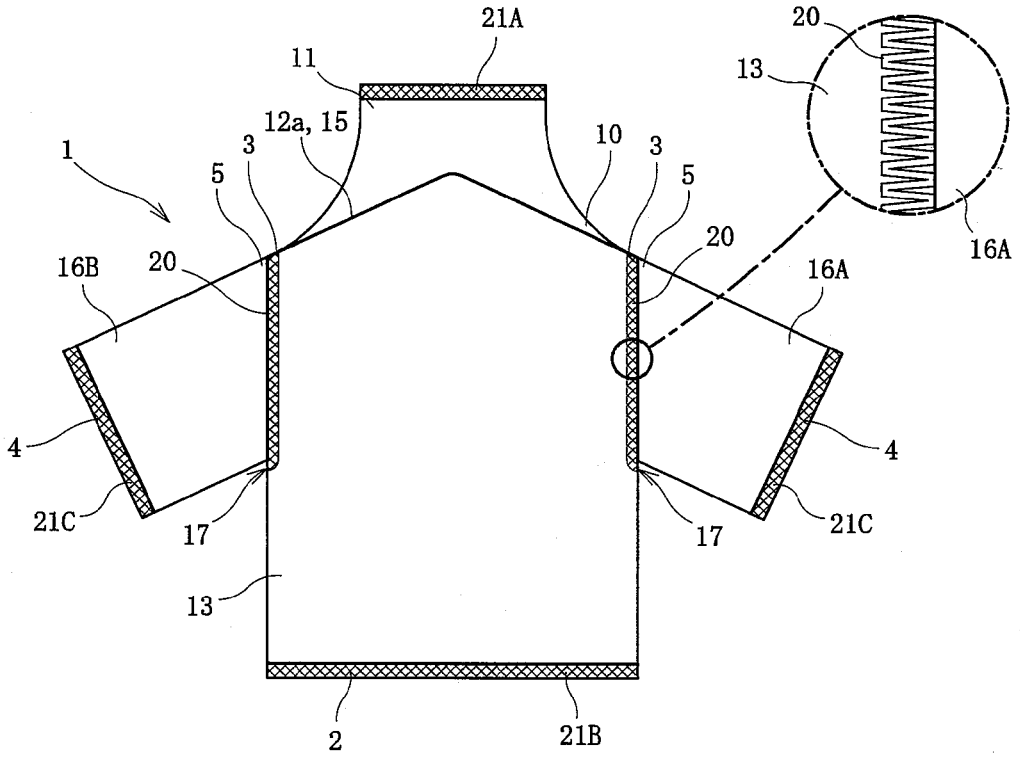
FIG. 14 is a rear view illustrating the underwear of FIG. 12 in the state of being turned inside out and flattened.

FIGS. 12 to 14 illustrate underwear 1 according to a third embodiment. The third embodiment is different from the respective embodiments in that the configuration of the sagging preventing portion 17 is further modified. Specifically, the sagging preventing portion 17 of the third embodiment is configured by a stretchable layer 20 that is formed by coating silicone rubber on the entire periphery along an armhole 3. The stretchable layer 20 is coated on the inside of a back body 13 and a front body 10. Herein, the sagging preventing portion 17 formed by the stretchable layer 20 is stronger in the contracting force but is weaker in the stretching property than the front body 10, the back body 13, and sleeves 16A and 16B. Accordingly, in the present embodiment, as illustrated in FIG. 14, the stretchable layer 20 is continuously provided in the shape of sawteeth such that the sagging preventing portion 17 can secure the stretching amount. Also, in the present embodiment, a neck line of a high neck portion 11, a hem line 2, and a sleeve hem 4 of the sleeves 16A and 16B are also provided with stretchable layers 21A, 21B and 21C formed by silicone rubber.

When the underwear 1 of the third embodiment is worn, the armhole 3 closely contacts the periphery of the shoulder of the wearer by the stretchable layer 20 with a strong contracting force. Likewise, by the stretchable layers 21A to 21C, the neck line, the hem line 2, and the sleeve hem 4 closely contact the wearer. Accordingly, a cloth sagging at the respective regions can be prevented. In addition, since the stretchable layers 20 and 21A to 21C of the present embodiment are formed by silicone rubber, the frictional resistance with respect to the wearer's skin can be increased. Accordingly, a cloth position sagging can be prevented more securely. As a result, even when the wearer moves the neck, the shoulders, the arms, or the like, the generation of a wrinkle at the front body 10 can be prevented securely.

Also, the underwear 1 of the present invention is not limited to the configurations of the embodiments, and various modifications may be made therein.

For example, in the embodiments, the front body 10 located on the front side of the wearer may be decorated with rhinestones or the like. Also, the high neck portion 11 may be decorated with rhinestones, a stretchable choker, or the like. In addition, in the embodiments, although the underwear is produced using a skin color stretchable material, a material having a different color from the skin may be used.

Figure 15:
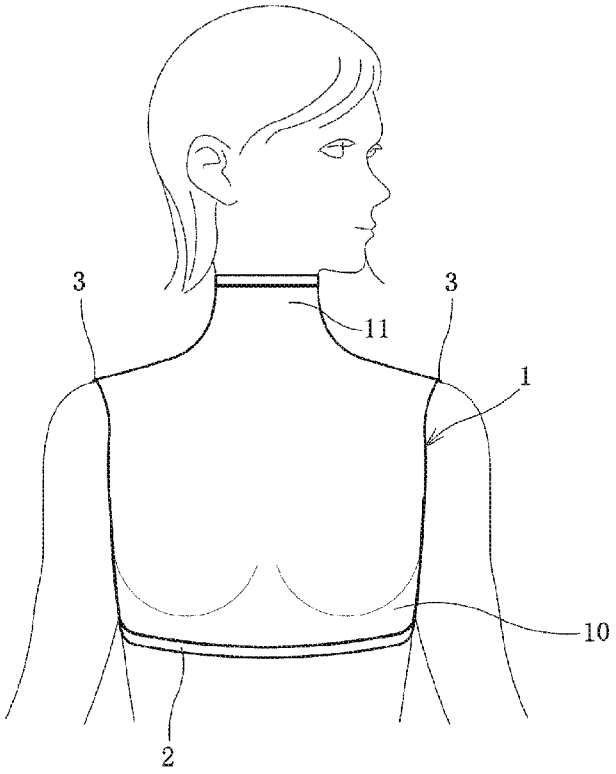
FIG. 15 is a front view illustrating a modification of the underwear.

Also, although, in the underwear 1 of the embodiments, the sleeves 16A and 16B are stitched to the armhole 3, a no-sleeve type without the sleeves 16A and 16B stitched may be possible as illustrated in FIG. 15. In addition, in the embodiments, although the length covers the top portion above the under bust, the length may cover the waist. However, in this case, as in the third embodiment, it may be preferable that an under bust portion is provided with a stretchable layer 21B for preventing an upward slippage.

In addition, in the first and second embodiments, the sagging preventing portion 17 is configured by the stretchable members 18, 18A and 18B having a stronger stretching force than the front body 10 and the back body 13. However, the sagging preventing portion 17 may be configured by the stretchable layer 20 as in the third embodiment. Needless to say, the sagging preventing portion 17 configured by the stretchable layer 20 in the third embodiment may also be configured by the stretchable member 18. In addition, the underwear 1 of the first and second embodiments may also be provided with the stretchable layers 21A to 21C as in the third embodiment, and the stretchable layers 21A to 21C may also be configured by the stretchable member 18.

The sagging preventing portion 17 is not limited to the stretchable member 18 and the stretchable layer 20, and various modifications may be made therein. For example, in the production of the front body 10 and the back body 13, by inserting a thread with different stretching property into a portion provided with the sagging preventing portion 17, the portion may be configured to have different stretching property than other portions. Also, the sagging preventing portion 17 may also be configured by inserting a general-purpose elastic string.

Also, in the respective embodiments, the sagging preventing portion 17 is provided. However, in particular, when the sleeves 16A and 16B are stitched, since both top portions of the front body 10 can be prevented from moving toward the high neck portion 11 by the sleeves 16A and 16B, the sagging preventing portion 17 may not be provided. Needless to say, even in the case of the no-sleeve type illustrated in FIG. 15, the sagging preventing portion 17 may not be provided. Also, in this case, a wrinkle or sag around the neck can be covered by at least the high neck portion 11.

Figure 16:
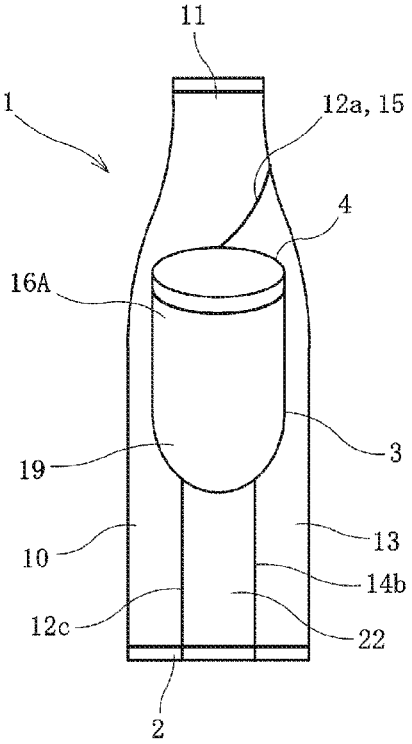
FIG. 16 is a side view illustrating another modification of the underwear.

In addition, in the embodiments, the back body 13 is directly stitched to the front body 10. However, as illustrated in FIG. 16, a side body 22 may be stitched between the front body 10 and the back body 13 by the same stretchable material, and the back body 13 may be stitched to the front body 10 through the side body 22.

In addition, in the embodiments, the back body 13 formed in a rectangular shape by cutting is stitched to the front body 10. However, the back body 13 may be stitched by the configuration in which corners at the side of the shoulder line 15 are chamfered along a chain line illustrated in FIG. 6A. In this way, the shoulder lines 12*a* and 15 switched to the front body 10 and the back body 13 can be located at the back side of the wearer.

What is claimed is:

1. An underwear comprising:

a front body formed of a stretchable cylindrical material and having a seamless cylindrical neck portion for covering a neck of a wearer at a top portion thereof, the seamless cylindrical neck portion being an integral portion of the front body; and a back body formed of the stretchable cylindrical material, the back body having:

a pair of bottom side edges stitched to a pair of bottom side edges of the front body;

a top edge stitched to a shoulder region of the front body and configured to extend from a bottom end of the neck portion to a shoulder of the wearer; and a pair of top side edges forming armholes;

wherein the front body has cutting edges formed by cutting the stretchable cylindrical material in a vertical direction from a bottom opening portion of the front body to the neck portion of the front body, the cutting edges of the front body comprising a shoulder line shaped to extend from a cutting end to both shoulders of the wearer, armhole lines positioned under the shoulder line, and side lines positioned under the armhole lines; and wherein the back body has cutting edges formed by cutting the stretchable cylindrical material in a vertical direction from a first end opening portion of the back body to a second end opening portion of the back body, the first end opening portion having a shoulder line stitched to the shoulder line of the front body, the cutting edges comprising armhole lines at a top portion, and side lines at a bottom portion and stitched to the side lines of the front body.

2. The underwear according to claim 1, further comprising a pair of cylindrical sleeves formed of the stretchable cylindrical material, the cylindrical sleeves being configured to prevent top portions of the front body from moving toward the neck portion, each of the cylindrical sleeves being stitched to a respective one of the armholes.

3. The underwear according to claim 1, further comprising a sagging preventing portion configured to prevent top portions of the front body from moving toward the neck portion such that at least a portion thereof is located around a respective one of the armholes.

4. The underwear according to claim 3, wherein the sagging preventing portion is located along a bottom side of a respective one of the armholes from the front body to the back body.

5. The underwear according to claim 3, wherein the sagging preventing portion is one of a pair of sagging preventing portions at the back body each extending from a respective one of the armholes of a first side toward a hem of a second side.

6. The underwear according to claim 3, wherein the sagging preventing portion is located around an entire periphery along a respective one of the armholes.

7. The underwear according to claim 3, wherein the sagging preventing portion is a stitched strip-shaped member.

8. The underwear according to claim 3, wherein the sagging preventing portion is a silicone coat.

9. The underwear according to claim 2, further comprising a sagging preventing portion formed of a strip-shaped stretchable member stitched such that at least a portion thereof is located around a respective one of the armholes, and the sagging preventing portion is configured to prevent top portions of the front body from moving toward the neck portion, wherein an armpit pad is stitched to the sagging preventing portion.

* * * * *